US006561849B2

(12) United States Patent
Naito et al.

(10) Patent No.: US 6,561,849 B2
(45) Date of Patent: May 13, 2003

(54) ELECTRICAL CONNECTOR HAVING AN IMPROVED OUTER CONDUCTIVE SHELL

(75) Inventors: Takaki Naito, Kanagawa (JP); Doron Lapidot, Tokyo (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/966,133

(22) Filed: Sep. 28, 2001

(65) Prior Publication Data

US 2002/0039857 A1 Apr. 4, 2002

(30) Foreign Application Priority Data

Sep. 29, 2000 (JP) ..... 2000-298756

(51) Int. Cl.[7] ..... H01R 13/648
(52) U.S. Cl. ..... 439/607
(58) Field of Search ..... 439/607, 609, 439/620, 610

(56) References Cited

U.S. PATENT DOCUMENTS

| | | | | |
|---|---|---|---|---|
| 4,820,175 A | | 4/1989 | Hasegawa et al. | 439/98 |
| 5,562,496 A | * | 10/1996 | Benjamin et al. | 439/607 |
| 5,685,739 A | * | 11/1997 | Davis et al. | 439/607 |
| 5,700,167 A | | 12/1997 | Pharney et al. | 439/676 |
| 5,885,100 A | * | 3/1999 | Talend et al. | 439/490 |
| 6,227,911 B1 | * | 5/2001 | Boutros et al. | 439/620 |

FOREIGN PATENT DOCUMENTS

| | | |
|---|---|---|
| EP | 0863581 A1 | 9/1998 |
| EP | 0959535 A1 | 11/1999 |
| EP | 1 139 510 A2 | 10/2001 |
| JP | 63-172071 | 11/1988 |
| JP | 1-150379 | 10/1989 |
| JP | 63-172071 | 11/1989 |
| JP | 10-511211 | 10/1998 |
| WO | WO9204745 | 3/1992 |
| WO | WO9533289 | 12/1995 |

* cited by examiner

*Primary Examiner*—Javaid Nasri

(57) ABSTRACT

An improved high speed connector is provided in which conductive pads (34) are alternately disposed on both sides of a board (10). The conductive pad (34*a*) transmits a + differential signal, and the conductive pad (34*b*) transmits a − differential signal. These conductive pads are disposed on the same surface (10*a*). The pad (34*c*) used for grounding is disposed on the opposite surface (10*b*) so that this pad (34*c*) is positioned between the conductive pads (34*a*) and (34*b*), thus forming one set of pads. In the case of the conductive pads (34*d*), (34*e*) and (34*f*) of another adjacent set, the pad (34*d*) which transmits a − differential signal is disposed on the same side as the pad (34*b*) of the previous set which transmits the same − differential signal. The pad (34*f*) used for grounding is disposed on the opposite side from the pads (34*d*) and (34*e*). The pad of a third set which is adjacent to the pad (34*e*) that transmits a + differential signal is a pad that transmits the same + differential signal. As a result, signal crosstalk is reduced.

12 Claims, 8 Drawing Sheets

ELECTRICAL CONNECTOR HAVING AN IMPROVED OUTER CONDUCTIVE SHELL

FIELD OF THE INVENTION

The present invention relates to an electrical connector assembly, and more specifically to an electrical connector assembly and female connector for high-speed signal transmission used in high-speed digital image transmission.

BACKGROUND OF THE INVENTION

Male connectors having a board in an electrical connector are known. The contact mechanism of the male connector disclosed in Japanese Utility Model Application Kokai No. H1-150379 is shown in FIG. 16 as one example of such a male connector. In this male connector 200, a plurality of conductive traces are disposed at a specified spacing on both sides of a insulative board 202, and are thus formed as contacts 204 of the male connector 200. These contacts 204 are disposed on both sides and are oriented opposite each other.

A female connector equipped with a shielding shell is disclosed in Japanese Utility Model Application Kokai No. S63-172071. This shielding shell is formed by being bent from a single metal plate, and is constructed from a shell part that is capped over the front surface of the housing. A bent part is bent to the rear from this shell part, and a retention leg part used for attachment to the board, which is further bent downward from the bent part. An integral shield (electromagnetic shield) is formed as a result of contact with the shield of a mating connector by the shell part, and grounding to the board via the bent part and retention leg part.

A female connector equipped with a similar shielding shell is disclosed in Japanese Patent Publication No. H10-511211. This female connector has a metal shell which contacts a mating connector, and a separate grounding member which electrically contacts this metal shell. This connector is constructed so that grounding to the board is accomplished by soldering the grounding member to the board.

In the conventional male connector as disclosed in Japanese Utility Model Application Kokai No. H1-150379, no consideration is given to crosstalk between the transmission paths formed by the conductive patterns. Accordingly, the transmitted signals are easily affected by such crosstalk. Furthermore, in cases where several of these conductive traces are used for power, the additional noise is generated.

Although the shielding shell of the female connector disclosed in Japanese Utility Model Application Kokai No. S63-172071 is integrally formed by being stamped and bent from a single metal plate, the distance from the contact section the retention leg that is grounded to the board is long. Accordingly, the inductance of the grounding path is large, further increasing the noise in the system.

Furthermore, the shielding shell of the female connector disclosed in Japanese Patent Publication No. H10-511211 is constructed from two parts, which is undesirable from a manufacturing perspective. It is desirable to reduce the number of parts required as well as to shorten the ground path allowing for high speed signal transmission.

SUMMARY

The present invention was devised in light of these problems. An object of the present invention is to provide an electrical connector assembly which prevents crosstalk and is suitable for high-speed transmission.

Another object of the present invention is to provide an electrical connector assembly which is inexpensive, and has improved impedance matching capabilities.

Still another object of the present invention is to provide a female connector having a ground connection that is suitable for high-speed signal transmission, and in which the number of parts required is also small.

The electrical connector assembly of the present invention is characterized by the fact that in an electrical connector assembly which is equipped with a housing, a plate-form insulating body which is held in the above-mentioned housing, and in which a plurality of conductive pads that contact mating contacts are formed on both sides, and cables which are connected to the above-mentioned conductive pads, [each of] the above-mentioned cables has a + signal wire and – signal wire used for differential transmission, and a ground wire, the above-mentioned + signal wire and – signal wire [of each cable] are connected to adjacent conductive pads on one side of the above-mentioned insulating body, while the above-mentioned ground wire is connected to a conductive pad on the other side [of the insulating body] which is positioned between the above-mentioned conductive pads to which the above-mentioned + signal wire and – signal wire are respectively connected, and the above-mentioned conductive pads are disposed so that the above-mentioned conductive pads to which the above-mentioned + signal wires or – signal wires are connected and conductive pads to which signal wires of the same phase belonging to other adjacent cables are connected are located in closest proximity to each other.

Furthermore, the electrical connector assembly of the present invention may be constructed so that conductive pads for power supply use are disposed to the outside of the rows of the conductive pads for signal use disposed on the insulating body. In this case, it is desirable that the conductive pads used for grounding of the power supply be disposed on the side of the conductive pads used for signals, and that the conductive pads on the active wire side be disposed to the outside of the conductive pads used for grounding. Furthermore, it is desirable that conductive pads used for the power supply be disposed on both sides of the rows of conductive pads used for signals.

BRIEF DESCRIPTION OF THE DRAWINGS

Below, a preferred embodiment of the electrical connector assembly 1 of the present invention will be described in detail with reference to the attached figures of which.

DETAILED DESCRIPTION OF THE INVENTION

Figure 1:
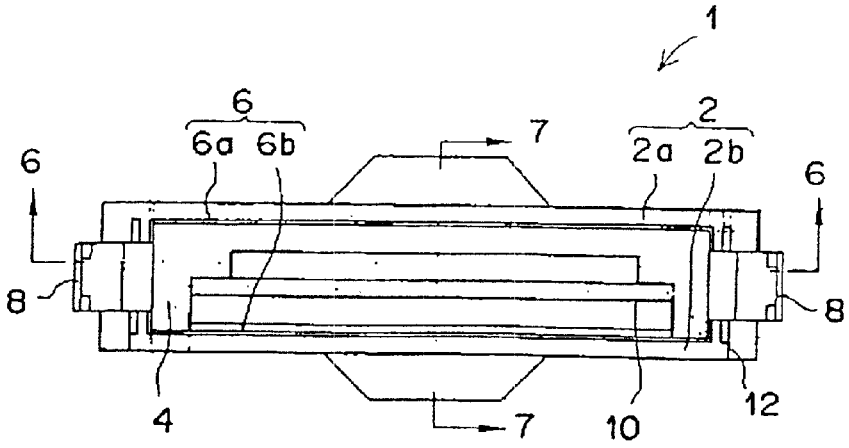
FIG. 1 is a front view of the electrical connector assembly of the present invention.
Figure 2:
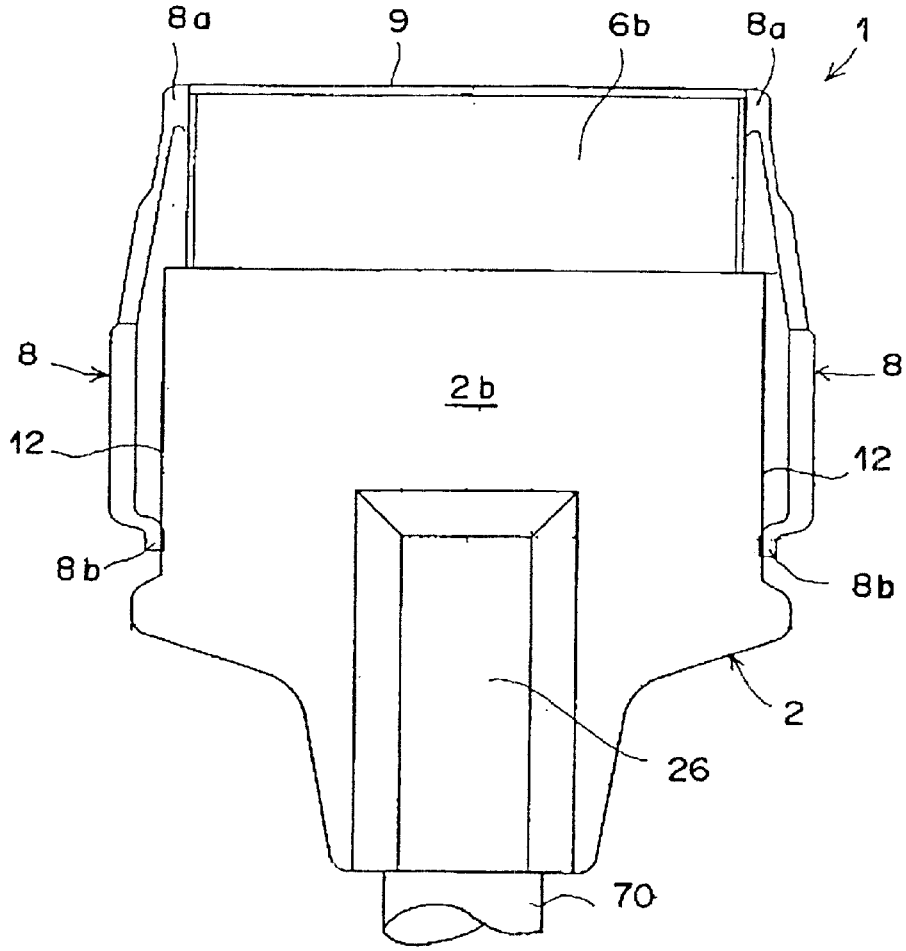
FIG. 2 is a bottom view of the electrical connector assembly shown in FIG. 1.
Figure 3:
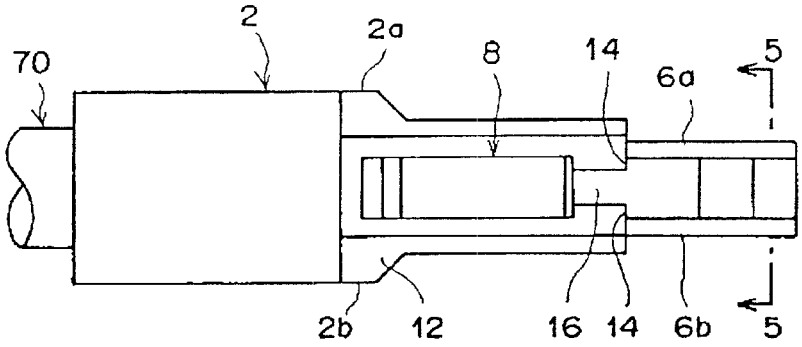
FIG. 3 is a side view of the electrical connector assembly shown in FIG. 1.

As is shown in FIG. 1, the connector 1 has a plastic cover member 2 consisting of two parts whose rear portions have a narrow width, and a metal shielding shell 6 consisting of a second pair of parts accommodated in this cover member 2. The cover member 2 consists of a set of cover member half-bodies 2*a* and 2*b*, and the shell 6 consists of a set of shell half-bodies 6*a* and 6*b*. A board holder hereafter referred to simply as a holder 4 which has a pair of latching arms 8 formed as integral parts is disposed inside this shell 6. The holder 4 holds an insulative board 10 inside. The board 10 is disposed along the length of an engaging part 9 approximately in the center of the engaging part 9. As is shown most clearly in FIGS. 2 and 3, the shell 6 is covered by the cover member 2 in such that the front part of the shell 6 is exposed.

The latching arms 8, 8 are formed as of cantilevers which have fixed ends 8*a* on the side surfaces of the front end portion of the holder 4, and which extend rearward at an angle. The free ends 8*b* are bent toward the side surfaces 12 of the cover member 2, and are positioned so that these free ends 8*b* are free to slide on the side surfaces 12. As is shown most clearly in FIG. 3, the latching arms 8 have a narrow-width part 16 which is formed in the center of the latching arm 8 and engaging shoulders 14 which face rearward and which form a continuation of the narrow-width part 16. When the connector 1 engages with a mating electrical connector 100 which will be described below (FIG. 10), these engaging shoulders 14 engage with the mating connector 100. Furthermore, such latching arms may also be disposed on the upper surface and/or undersurface of the holder 4. Moreover, an expanded part 26 extends rearward along the axial wire from the cover member 2 and a cable 70 is accommodated inside this expanded part 26. Details of the attachment relationship between the holder 4 and the board 10 will be described in further detail below.

Figure 4:
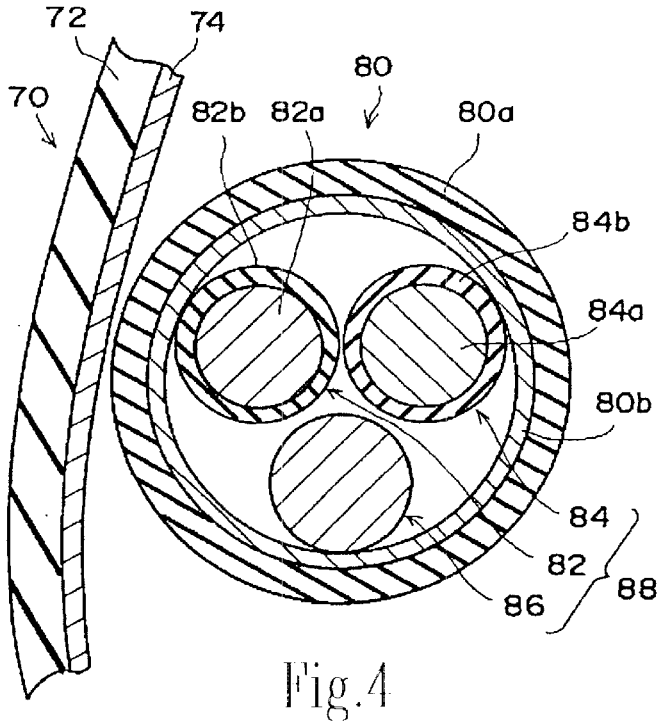
FIG. 4 is a sectional view of the cable.

The cable used in this connector 1 will now be described with reference to FIG. 4. This cable 70 has an insulating outer jacket 72 and a braided wire 74 which functions as a ground. The cable 70 also contains a plurality of small-diameter cables 80 on the inside. The small-diameter cables 80 are generally cables of the type known as shielded twisted pair cables, which are suitable for use in high-speed digital differential signal transmission. As is clear from FIG. 4, each of these small-diameter cables 80 has an insulating outer jacket 80*a*, an aluminum foil shield 80*b* that covers the inside surface of this outer jacket 80*a*, and three types of electrical wires 88 on the inside of this aluminum foil 80*b*. These electrical wires 88 consist of a + signal wire 82, a − signal wire 84 and a ground wire 86. These three electrical wires 88 are twisted together and disposed inside the aluminum foil 80*b* of each small-diameter cable 80. The + signal wire 82 and − signal wire 84 have respective signal conductors 82*a* and 84*a*, and have insulating outer jackets 82*b* and 84*b* that cover these signal conductors 82*a* and 84*a*. The ground wire 86 is a bare electrical wire, and is accommodated in a state in which this wire contacts the aluminum foil 80*b*.

Figure 5:
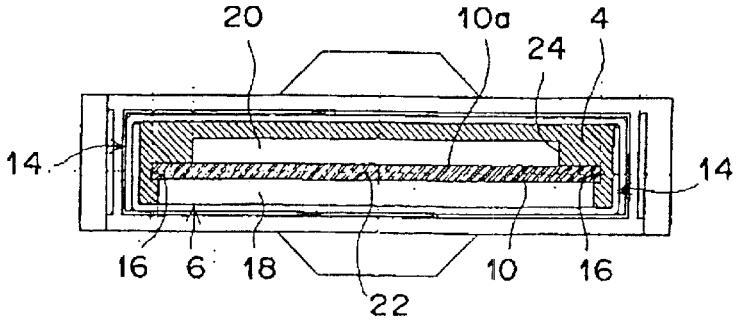
FIG. 5 is a sectional view along line 5—5 in FIG. 3.
Figure 6:
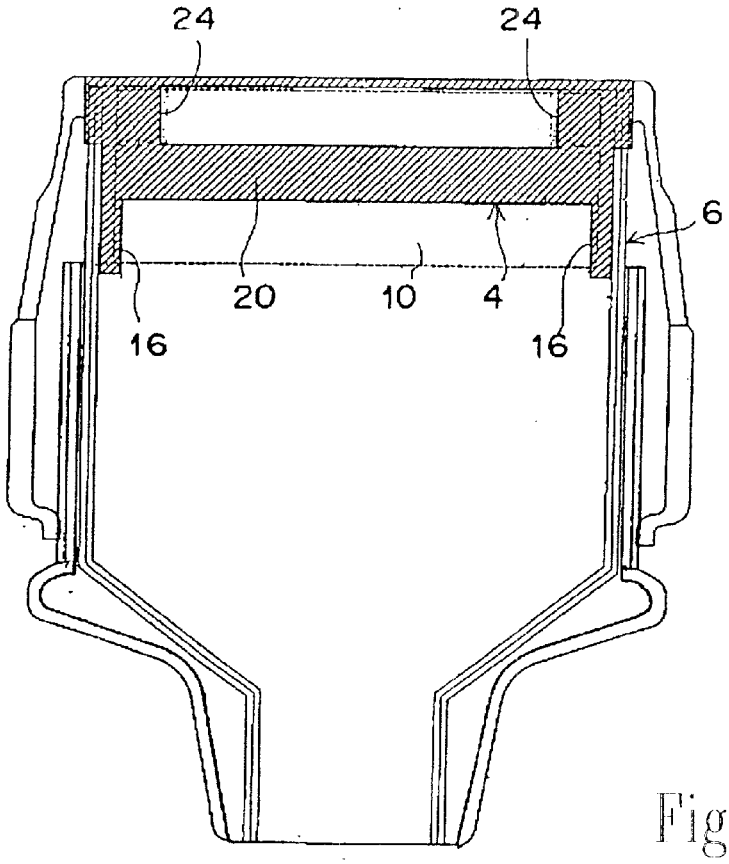
FIG. 6 is a sectional view along line 6—6 in FIG. 1.
Figure 7:
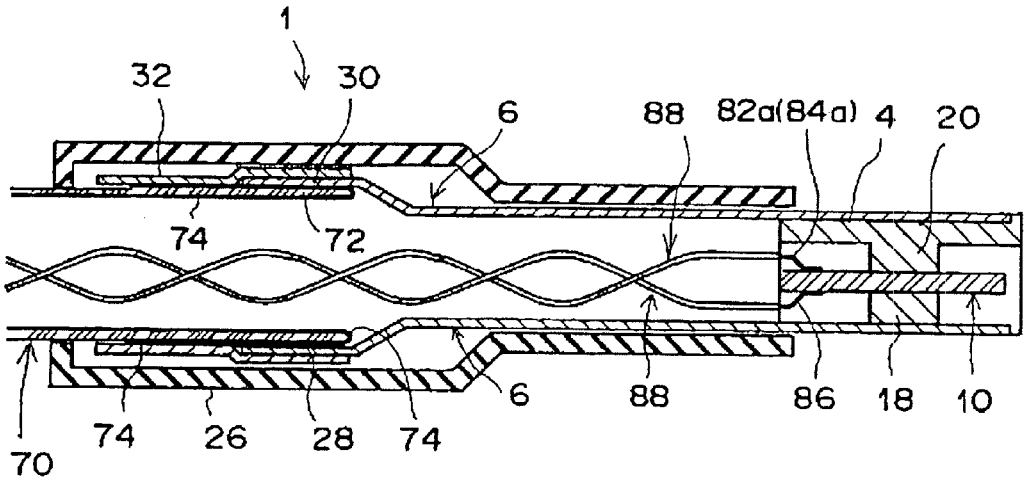
FIG. 7 is a sectional view along line 7—7 in FIG. 1.

The following description will refer to FIGS. 5 through 7. The shell half-bodies 6*a* and 6*b* are arranged so that the side walls 14 are overlapped with each other. Then, with the holder 4 disposed on the inside, the shell half-bodies 6*a* and 6*b* are anchored to each other by a known method such as interlocking engagement or latching engagement. As a result, the holder 4 is also held inside the shell 6. Guide grooves 16 which accommodate the board 10 are formed in both sides of the holder 4, and supporting parts 18 and 20 are formed in the central portion. The space between the supporting parts 18 and 20 forms a board passage 22 into which the board is inserted. Projecting parts 24 which contact the upper surface 10*a* of the board 10 are formed on both sides of the upper part of the front end portion of the holder 4. When the board 10 is supported by the holder 4, the approximate central portion of the board 10 is supported in the holder 4 by the supporting parts 18 and 20, and both sides of the upper surface 10*a* are supported up to the front end of the board 10. Conductive pads 34 which will be described below (FIG. 8) are disposed on exposed upper and lower surfaces of the front end of the board 10.

Next, the connection of the cable 70 and board 10 will be described with reference to FIG. 7. The end portion 28 of the cable 70 is disposed inside the expanded part 26 near the rear end of the connector 1. The electrical wires 88 of the small cables 80 which are exposed from the end portion 28 are terminated by soldering to conductive pads (not shown in the figures). Furthermore, the outer coverings 80*a* and aluminum foils 80*b* of the small cables 80 are omitted from FIG. 7. The signal conductors 82*a* and 84*a* are exposed from the ends of the electrical wires 88, and these signal conductors 82*a* and 84*a* and the ground wires 86 are connected to the conductive pads. In FIG. 7, only two electrical wires 88 are shown twisted together for purposes of description. In actuality, however, a plurality of electrical wires 88 are disposed inside the shell 6 and connected to the board 10, with sets of three wires taken as a unit.

The braided wire 74 positioned on the inside of the cable 70 is stripped from the end of the outer jacket 72; this braided wire 74 is folded back over the end portion 28 of the cable 70 and disposed inside the rear part 30 of the shell 6. A metal ferrule 32 is fit over the outside of the rear part 30 of the shell 6 and the outside of the end portion 28 of the cable 70. This ferrule 32 is crimped so that the shell 6 and braided wire 74 are electrically connected.

Figure 8:
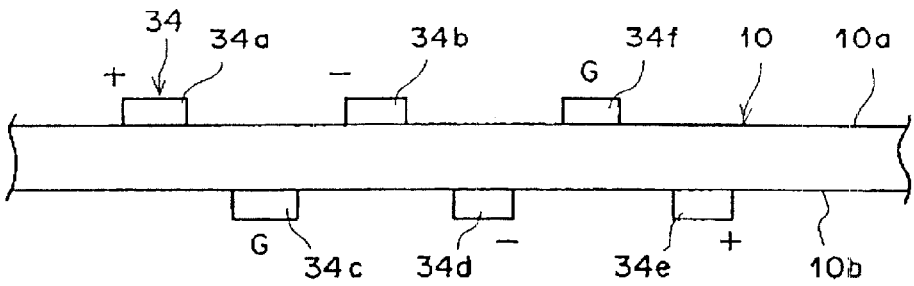
FIG. 8 is an enlarged front view which shows a partial view of the board on which conductive pads are alternately disposed at a specified spacing.

Next, the board 10 will be described with reference to FIG. 8. FIG. 8 is an enlarged front view which shows a partial view of the board 10 on which conductive pads 34 are alternately disposed at a specified spacing. On this board 10, the conductive pads hereafter referred to simply as "pads" 34 are alternately disposed on both sides of the board 10. These conductive pads 34 are connected to the conductive pads to which the electrical wires 88 are connected. The width of the pads 34 is set at a width which allows impedance matching to be obtained. Taking the working characteristics of the connection with the electrical wires 88 and the engagement characteristics with the mating connector into consideration, the width of the pads 34 at both ends is set so that this width is greater than the width of the other portions of the pads 34. For purposes of impedance matching, however, it is desirable that the length of the pads 34 with a specified width be as long as possible.

Alternatively, the pads 34 may be integrally formed with the same width. The polarity of these conductive pads 34 may be described as follows: for example, assuming that the conductive pad 34*a* positioned furthest to the left in FIG. 8 transmits a + differential signal, and that the conductive pad 34*b* transmits a – differential signal, then conductive pads 34 with these polarities are disposed on the same upper surface 10*a*. The pad 34*c* used for grounding is disposed on the opposite surface 10*b* so that this pad 34*c* is positioned between the conductive pads 34*a* and 34*b*. The signal conductors 82*a* and 84*a* and ground wire 86 of one set of the above-mentioned electrical wires 88 are correspondingly connected to these conductive pads 34*a* through 34*c*. Furthermore, the symbols +, – and G are shown near the conductive pads 34 in FIG. 8 as a visual aid.

In another adjacent set of pads 34*d*, 34*e* and 34*f*, the pads 34*d* and 34*e* used for signals are disposed on the same side as the pad 34*c* used for grounding in the previous set. In this case, the pad 34*d* which transmits a – differential signal is disposed near the pad 34*b* of the previous set that transmits the same – differential signal. The pad 34*f* used for grounding is disposed on the opposite side from the pads 34*d* and 34*e*. This is done in order to avoid effects of the signals on each other by locating pads 34 that have the same polarity close to each other. Specifically, the rise of the pulses of signals that rise in the same direction are prevented from being delayed or deformed. The pad of a third set (not shown in the figures) adjacent to the pad 34*e* that transmits a + differential signal is also a pad that transmits the same + differential signal. Accordingly, the pad 34*e* that transmits a + differential signal is also prevented from receiving any effect from adjacent pads. Thus, the electrical wires 88 of respective adjacent units are connected to the conductive pads 34 so that the same polarities are adjacent to each other between the respective units. As a result, crosstalk is reduced.

Figure 9:
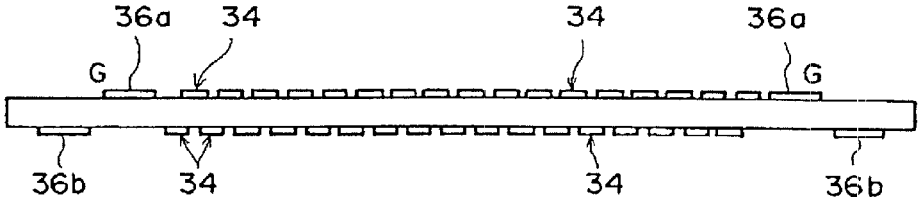
FIG. 9 is an overall front view of the board.

An overall front view of the board 10 is shown in FIG. 9. In the board 10 shown in FIG. 9, pads 36 used for the power supply are disposed on both surfaces of the board 10 at both ends. In the case of this embodiment, there are two power supply systems. Accordingly, two pads 36 each are disposed at both ends to the outside of the rows of pads 34 used for the electrical wires 88. The pads 36*a* used for the grounding of the power supply are disposed on the same side as the pads 34 used for the electrical wires 88, and the pads 36*b* used for the active wire side of the power supply are disposed on the opposite side from the pads 36*a* used for grounding, and even further from the pads 34. As a result, the effect of the pads 36 used for the power supply on the pads 34 is reduced, and the danger that noise from the power supply will effect the pads 34 used for the signal wires 82 and 84 is also reduced. Furthermore, the symbol G is shown near the conductive pads 36*a* used for grounding in FIG. 9.

Figure 10:
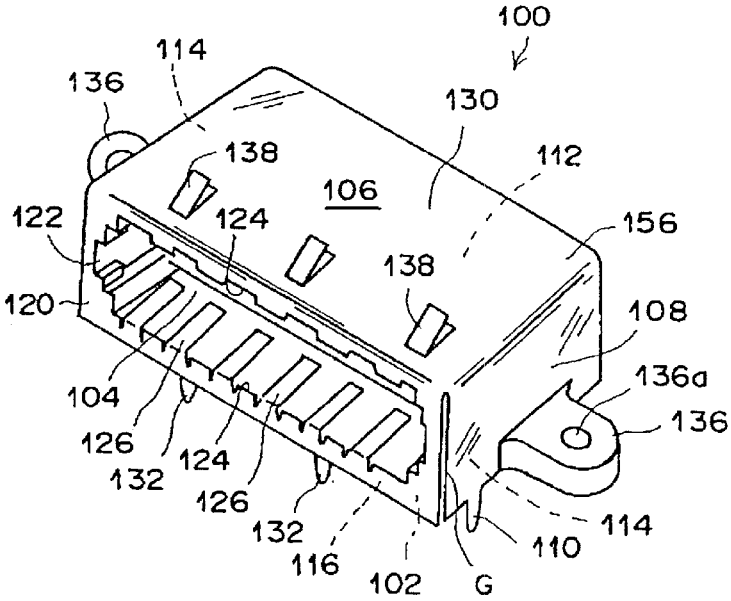
FIG. 10 is a perspective view of the other female connector.
Figure 11:
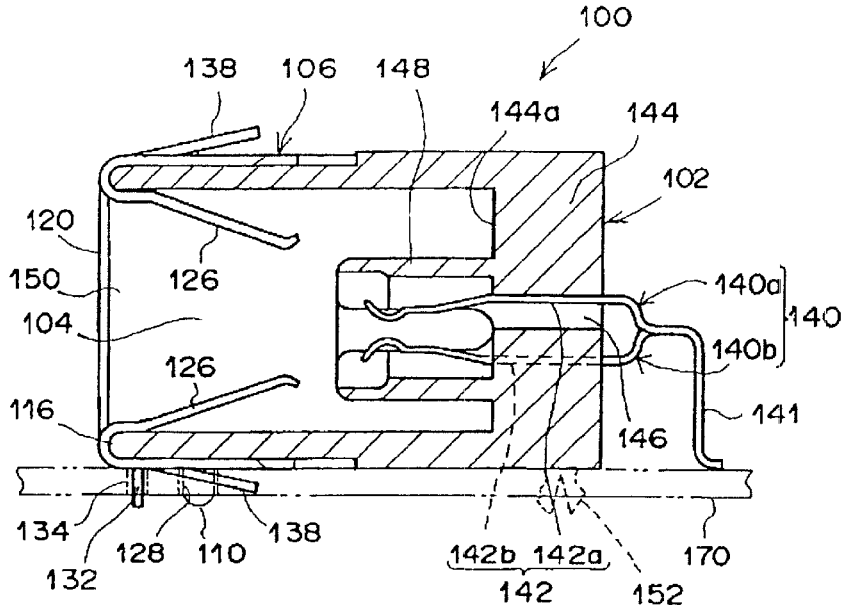
FIG. 11 is a longitudinal sectional view of the female connector shown in FIG. 10.

Next, the other connector 100 of the present invention with which the connector 1 is engaged will be described with reference to FIGS. 10 and 11. FIG. 10 is a perspective view of the female connector hereafter referred to simply as a "connector" 100. FIG. 11 is a longitudinal sectional view of the same. The following description will refer to FIGS. 10 and 11. This connector 100 has an insulating housing 102 which has an engaging recess 104, and a shielding shell 106 which is mounted on the outside of this housing 102. The shell 106 is formed by stamping and bending a single metal plate, and has a main body 156 which covers the upper wall 112 and side walls 114 of the housing 102, and a face plate 120 which covers the front surface 116. The face plate 120 which covers the front surface 116 of the housing 102 is separated by cutting from the side walls 108 of the shell, so that gaps G are formed.

An opening 122 is formed in the inside of the face plate 120 in a position corresponding to the engaging recess 104. Spring contacts 126 are formed by being bent from the upper and lower inside edges 124 of this opening 122 at a specified spacing so that these spring contacts 126 enter the interior of the engaging recess 104. When these spring contacts 126 are engaged with the connector 1, the contacts contact the shell 6 of the connector 1, so that both connectors are grounded. During use, this connector 100 is fastened to an attachment board 170 indicated by a phantom lines in FIG. 11. In this case, ground connection to grounding conductors (not shown in the figures) on the attachment board 170 is generally accomplished by tongue parts 110 that drop from the respective side walls 108 of the shield 106. Generally, that is, the tongue parts 110 are disposed inside corresponding openings 128 formed in the attachment board 170, and grounding conductors (not shown in the figures) that communicate with these openings 128 are connected by soldering.

However, the length of the path to the tongue parts 110 used for grounding is different for the upper-side spring contacts 126 and lower-side spring contacts 126 of the face plate 120. Specifically, the electrical path from the upper-side spring contacts 126 to the tongue parts 110 runs from the upper wall 130 of the shell 106 via the side walls 108. In the case of the lower-side spring contacts 126, however, the electrical path runs around the periphery of the face plate 120, and then reaches the upper wall 130 by passing through portions with a narrow width, after which the path reaches the tongue parts 110 via the side walls 108. As a result, the path length from the lower-side spring contacts 126 is increased, so that the grounding path forms a large loop, thus increasing the inductance. Accordingly, noise tends to be picked up, and this interferes with the differential transmission function, so that there is a danger of a drop in the transmission quality and a drop in the noise resistance.

For this reason, two tongue parts 132 which are similar to the tongue parts 110 and which are especially provided for use on the face plate 120 are formed on the lower side of the face plate 120 by being cut out and bent to protrude at a certain spacing. These tongue parts 132 are inserted into openings 134 formed in the attachment board 170 (see FIG. 11), so that grounding is accomplished via the shortest path. As a result, there are no great differences in the transmission paths.

The attachment of the connector 100 to the attachment board 170 is accomplished by means of attachment tabs 136 which are caused to protrude from the side walls 114 of the housing 102 in two places. Specifically, screws (not shown in the figures) are inserted into through-holes 136*a* formed in the attachment tabs 136, and fastening is accomplished by these screws. Furthermore, in cases where screw fastening is not used, it would also be possible to form retention legs 152 on the shell 106 as indicated by the phantom lines (FIG. 11), and to fasten the connector 100 to the attachment board 170 by means of these retention legs 152.

A plurality of contacts 138 are formed along the engagement part on the front end portions of the upper wall 130 of the shell 106 by being cut out and bent to protrude from the upper wall 130. These contacts 138 are used for grounding to an attachment panel (not shown in the figures) by the front part of the connector 100 when the engagement part of the connector 100 is pushed into this attachment panel. As is shown in FIG. 11, similar contacts 138 are also formed for the same purpose on the lower side of the shell 106. In cases where the connector 100 is grounded to the attachment board 170 using the tongue parts 132, these contacts 138 are not necessary.

Next, the contacts of the connector 100 will be described with reference to FIG. 11. In each of these contacts 140, the tine 141 has the same shape, and the contacts 140 consist of two types of contacts 140*a* and 140*b*, in one of which the contact arm 142 is bent upward from the tine 141, and in the other of which the contact arm 142 is bent downward from the tine 141. The contact arms 142*a* of the contacts 140*a* and the contact arms 142*b* of the contacts 140*b* are symmetrical, and are bent so that the contact arms are constrained toward the inside facing each other. The ends are bent outward so as to guide and contact the other contacts, i.e., the pads 34 and 36 of the above-mentioned connector 1.

In regard to the attachment of the contacts 140, the contacts 140 are press-fitted and anchored in the housing 102 by being pushed from the rear into contact through-holes 146 alternately formed in the rear wall 144 of the housing 102. The tip end portions of the contacts 140 are protected by being covered by covering walls 148 which are caused to protrude forward, from the inside surface 144*a* of the rear wall 144 of the housing 102. The electrical signals that pass through the symmetrical contacts 140*a* and 140*b* pass through the tine parts 141 that have the same shape; consequently, no difference (skewing) is generated in the transmission velocity of the electrical signals. Accordingly, the transmission quality and noise resistance can be maintained.

Figure 12:
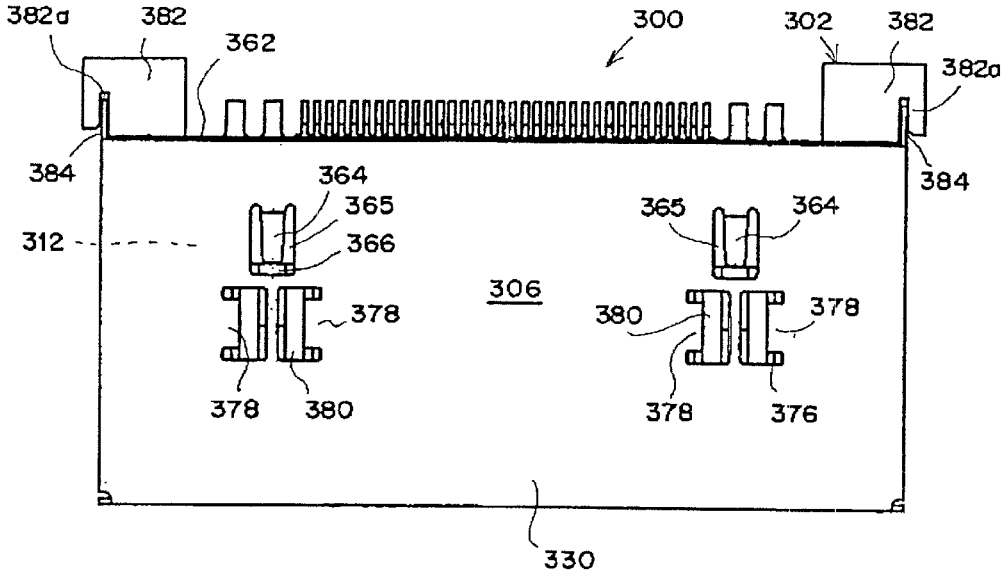
FIG. 12 is a plan view of a female connector constituting a second embodiment of the present invention.
Figure 13:
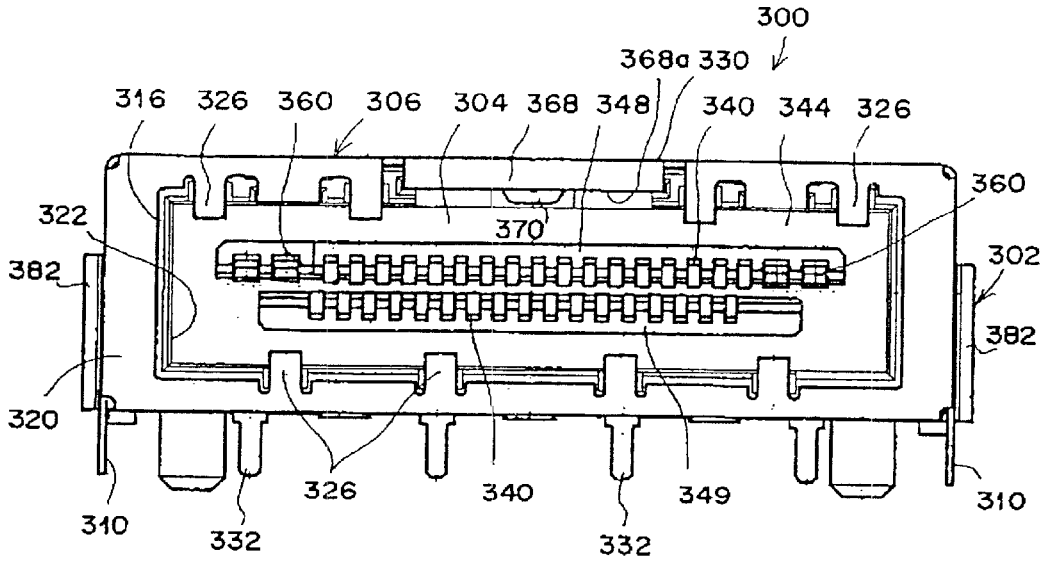
FIG. 13 is a front view of the connector shown in FIG. 12.
Figure 14:
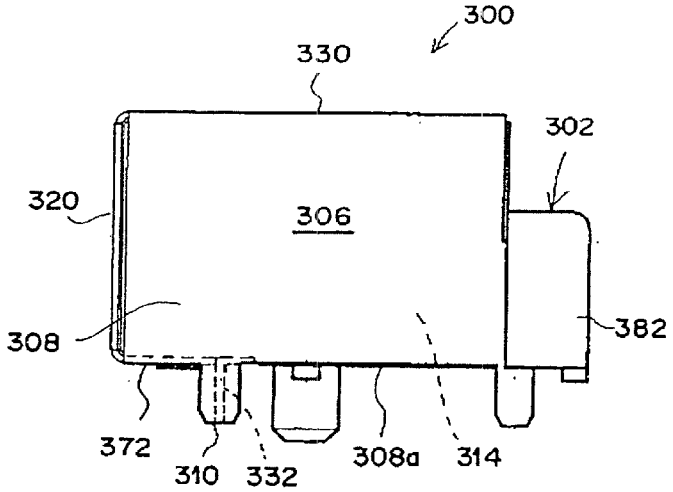
FIG. 14 is a side view of the connector shown in FIG. 12.

Next, a female connector hereafter referred to simply as a "connector" constituting a second embodiment of the present invention is shown in FIGS. 12 through 14. The housing 302 of the connector 300 is molded from an insulating resin, and has a substantially rectangular-solid shape. A rectangular opening 322 which is long in the lateral direction is formed in the front surface 316 of the housing 302. An engaging recess 304 is formed into the interior of the housing 302 from this opening 322. As is shown most clearly in FIG. 13, two plates, i.e., upper and lower plates 348 and 349, which extend in the lateral direction protrude in close proximity to each other in the direction perpendicular to the plane of the page from the rear wall 344 of the engaging recess 304 in the approximate center of the engaging recess 304. The upper-side plate 348 is slightly longer than the lower-side plate 349. A plurality of contacts 340 are disposed at specified intervals on the respective plates 348 and 349 so that the contacts on each plate face toward the other plate. Two power supply contacts each are disposed on both end portions of the upper-side plate.

A metal shell 306 used for shielding, which has the same shape as the housing 302, is mounted on the outside of the housing 302. Since this shell 306 has a shape similar to that of the shell 106 in the above-mentioned embodiment, a detailed description of this shell 306 will be omitted. However, the main points of difference will be described below. Latching arms 364 which face forward and are inclined toward the housing 302 inside are formed inside openings 365 which are formed in the upper wall 330 of the shell 306 on the left and right sides near the rear end 362 of the upper wall 330. When the housing 302 is inserted into the shell 306 from the side of the rear end 362 of the shell 306, these latching arms 364 act in conjunction with projections 366 formed on the upper wall 312 of the housing 302, so that the housing 302 is prevented from slipping out in the rearward direction.

Rectangular-solid blocks 382 protrude from both sides of the rear part of the housing 302 as integral parts of the housing 302. Tab grooves 382*a* which accommodate rear tabs 384 that protrude from the rear end 362 of the shell 306 are formed in these blocks 382. When the housing 302 is mounted in the shell 306, the rear tabs 384 enter the tab grooves 382*a*, so that the movement of the housing 302 in the forward direction is restricted.

Tongue parts 378 formed by C-shaped slots 376 are disposed on the upper wall 330 of the shell 306, with two of these tongue parts 378 being disposed facing each other in the vicinity of each latching arm 364. Meanwhile, projections 380 with a cross-sectional T shape which have grooves in both sides are formed on the upper wall 312 of the housing 302 in positions facing the tongue parts 378. The tongue parts 378 are anchored by being inserted into the grooves of these projections 380 from both sides. As a result, the upper wall 330 of the shell 306 is prevented from floating upward from the upper wall 312 of the housing 302.

The connector 300 of the second embodiment is of a type that is attached with the front surface 316 contacting a panel (not shown in the figures), so that there is no construction corresponding to the contacts 138 of the previous embodiment (FIG. 10). The spring contacts 326 are lined up in a row inside the engaging recess 304 from the face plate 320, with four of these spring contacts 326 being formed at approximately equal intervals on the lower side, and two spring contacts 326 each being disposed in positions biased toward both ends on the upper side. An inside extension part 368 which is bent from the upper wall 330 of the shell 306 at the front surface 316 of the housing 302 extends into the interior of the engaging recess 304 and is formed between the two upper-side spring contacts 326 that are positioned on the inside. An anchoring projection 370 protrudes into the interior of the engaging recess 304 from the inside surface 368*a* of the inside extension part 368. This anchoring projection 370 forms a locking part that secures the connector 300 with a complementary male connector (not shown in the figures).

Tongue parts 332 are formed by being cut out and raised from a bent part 372 that is folded over the undersurface of the housing 302 from the lower part of the face plate 320. The respective tongue parts 332 are disposed in the vicinity of the lower-side spring contacts 326. These tongue parts 332 form grounding paths that reach the board from the lower-side spring contacts 326. Furthermore, since a plurality of tongue parts 332 are formed in close proximity to the face plate 320 and as integral parts of the face plate 320, even if torsion is generated during the insertion of the connector 1, this force will be dispersed and received by the plurality of tongue parts 332, so that the torsion resistance is improved.

Side walls 308 which cover the side walls 314 of the housing 302 are formed by being bent from the upper wall 330 of the shell 306. Tongue parts 310 protrude downward from the lower ends 308*a* of these side walls 308 of the shell 306, on portions of these lower ends that are located near the front of the shell. These tongue parts 310 form grounding paths that reach the board from the upper-side spring contacts 326.

Figure 15:
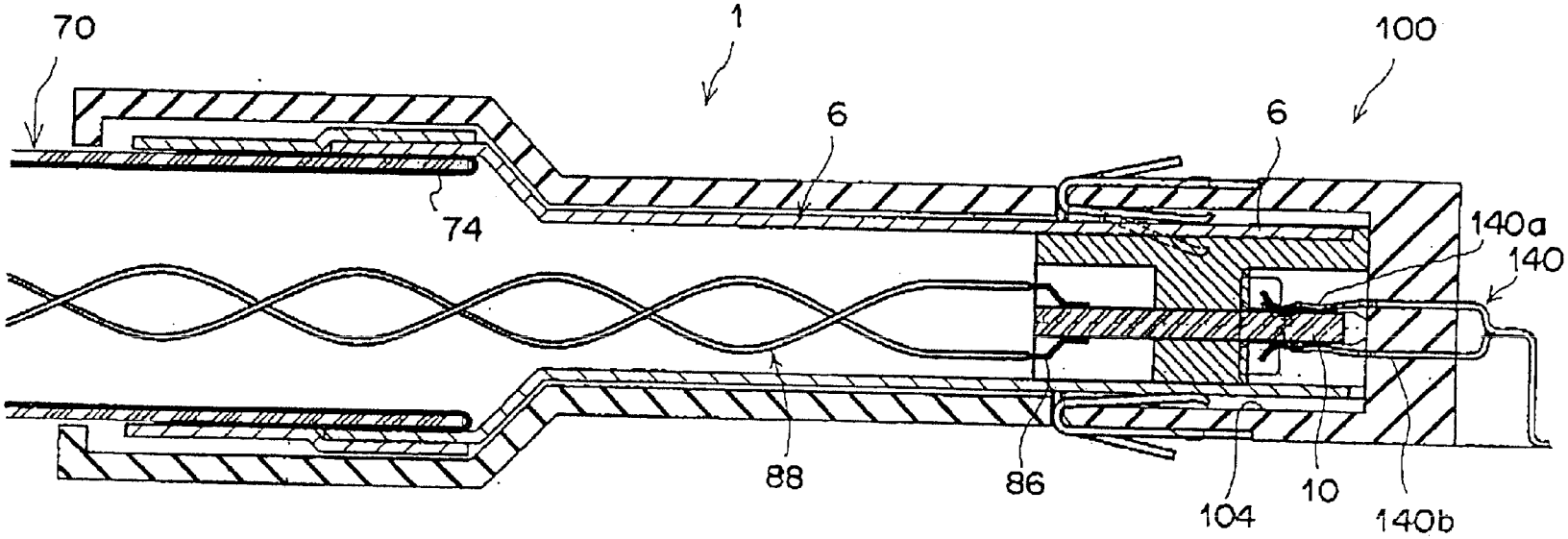
FIG. 15 is a sectional view of the electrical connector assembly of the present invention mated with another connector.
Figure 16:
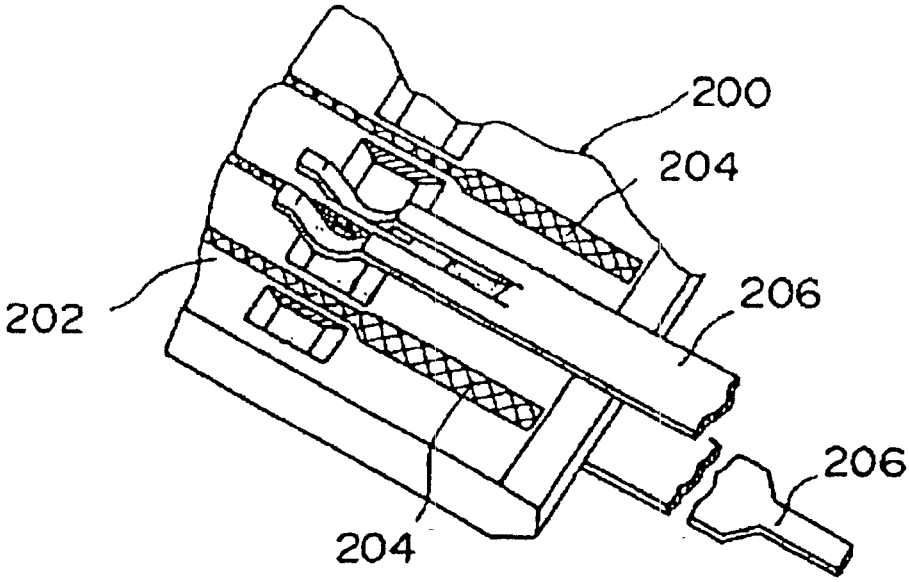
Fig.16 PRIOR ART
FIG. 16 is a perspective view which shows one example of a conventional electrical connector.

Next, a sectional view of the connector 1 mated with connector 100 is shown in FIG. 15. When the connectors are mated, the shell 6 of the connector 1 advances into the interior of the engaging recess 104 of the connector 100, and the shell 6 and spring contacts 126 of the shell 106 are grounded to each other. Furthermore, the board 10 advances into the spaces between the contact arms 140*a* and 140*b* of the contacts 140, so that the pads 34 and 36 and the contacts

140 are electrically connected to each other. In this case, a grounding path is continuously formed from the braided wire 74 of the cable 70 of the connector 1 to the shell 106 of the connector 100 and the attachment board 170 via the shell 6, so that this path is formed as a frame ground. Furthermore, the grounding path connected to the contacts 140 from the ground wires 86 of the electrical wires 88 via the board 10 constitutes a signal ground. High-speed transmission is achieved by thus separating the grounding paths.

As a result, in the connector 100, there is little difference in the lengths of the grounding paths that extend from the upper and lower spring contacts 126 of the face plate 120 to the attachment board 170, so that grounding to the attachment board can be accomplished by the shortest path. As a result, the grounding path does not form a large loop, so that the inductance of the grounding path is reduced to achieve improved noise resistance.

Advantageously, in the electrical connector assembly of the present invention, each of the cables has a + signal wire and – signal wire used for differential transmission, and a ground wire. Furthermore, the + signal wire and – signal wire of each cable are connected to adjacent conductive pads on one side of a board held in the housing, and the ground wire is connected to a conductive pad on the other side which is positioned between the adjacent conductive pads to which the signal wires are connected. Moreover, conductive pads to which the signal wires are connected and conductive pads to which signal wires of the same phase belonging to other adjacent cables are connected are disposed so that these conductive pads are in closest proximity to each other. Accordingly, adjacent conductive pads are disposed so that signal wires of the same phase are in close proximity to each other, thus eliminating mutual electrical influence of the signal wires on each other. Accordingly, there is no blunting of the rise of the signals, so that this system is suitable for high-speed transmission; furthermore, crosstalk can be prevented. Since the contacts are formed by conductive pads, the width of the conductive pads and the spacing of adjacent conductive pads can be precisely formed, so that optimal impedance matching is possible.

What is claimed is:

1. A female connector comprising:

an insulating housing in which first contacts are held inside a substantially rectangular engaging recess that accommodates a male connector, and a shell used for shielding, which is made of metal and which is externally mounted on the housing, and which is attached to a board so that the shell is grounded to the board, the shell having a face plate which covers at least a front surface of the housing, a plurality of spring contacts which contact the male connector being disposed on the face plate on an upper side and a lower side of the engaging recess, and a plurality of tongue parts which are grounded to the board protruding from a lower side of the face plate in close proximity to the lower side spring contacts.

2. The female connector claimed in claim 1, which is characterized by the fact that the face plate of the shell is bent from an upper wall of the shell that covers an upper wall of the housing, side walls which cover respective side walls of the housing are bent from the upper wall of the shell, and other tongue parts which ground the upper side spring contacts to the board protrude from the side walls of the shell.

3. The female connector of claim 1, further comprising side walls bent from an upper wall of the shell.

4. The female connector of claim 3, further comprising a second tongue part that protrudes from a bottom surface of at least one side wall to ground the upper side contacts.

5. The female connector of claim 4, wherein a gap separates the side walls from the face plate.

6. The female connector of claim 1, wherein the tongue parts are cut and raised from a bent part of the face plate that is folded over an undersurface of the housing.

7. A female connector for mounting on a board comprising:

an insulating housing having an opening for receiving a complementary male connector, the male connector having a conductive outer shell;

a conductive shielding shell substantially surrounding the insulative housing, the shielding shell having side walls and a face plate positioned on a mating face of the insulating housing and substantially surrounding the opening for receiving the complementary male connector;

a plurality of first and second spring contacts extending from the face plate into the opening; and, a first tongue for grounding the first contacts extending from the face plate outward from the opening to engage ground contacts on the board and a second tongue for grounding the second contacts extending from at least one of the side walls to engage ground contacts on the board, the first and second tongues positioned such that a first grounding path from the first contacts to the board and a second grounding path from the second contacts to the board have substantially the same length.

8. The female connector of claim 7, wherein the face plate of the shell is bent from an upper wall and the side walls of the shell are also bent from the upper wall.

9. The female connector according to claim 8 further comprising a plurality of outer contacts extending outward from the upper wall.

10. The female connector of claim 7 wherein a short ground path extends from the conductive outer shell of the complementary male connector through the spring contacts extending within the opening, then through a short distance of the face plate to the tongue which is electrically grounded to the printed circuit board.

11. The female connector of claim 7, wherein a gap separates the side walls from the face plate.

12. The female connector of claim 7, wherein the first tongue parts are cut and raised from a bent part of the face plate that is folded over an undersurface of the housing.

* * * * *